US011713184B2

(12) United States Patent
Goradesky

(10) Patent No.: US 11,713,184 B2
(45) Date of Patent: Aug. 1, 2023

(54) MULTI-COMPARTMENT DUAL LID STORAGE CONTAINER

(71) Applicant: Buddy Box, LLC, Weston, FL (US)

(72) Inventor: Harold Scot Goradesky, Plantation, FL (US)

(73) Assignee: Buddy Box, LLC, Weston, FL (US)

( * ) Notice: Subject to any disclaimer, the term of this patent is extended or adjusted under 35 U.S.C. 154(b) by 0 days.

(21) Appl. No.: 17/591,351

(22) Filed: Feb. 2, 2022

(65) Prior Publication Data

US 2022/0242656 A1 Aug. 4, 2022

Related U.S. Application Data

(60) Provisional application No. 63/144,595, filed on Feb. 2, 2021.

(51) Int. Cl.
*B65D 1/04* (2006.01)
*B65D 85/10* (2006.01)
*B65D 43/16* (2006.01)

(52) U.S. Cl.
CPC ..... *B65D 85/1056* (2020.05); *B65D 43/16* (2013.01); *B65D 85/1048* (2020.05)

(58) Field of Classification Search
CPC ..... A24F 23/00; A24F 15/20; A24F 15/18; A24F 15/12; A24F 1/28; A24F 9/16; B65D 43/16; B65D 85/1048; B65D 85/1056; B65D 23/12; B65D 1/04; B65D 1/06; B65D 81/32
USPC ..... 206/268, 256; 131/180, 250; 220/819; 215/386
See application file for complete search history.

(56) References Cited

U.S. PATENT DOCUMENTS

| | | | | | |
|---|---|---|---|---|---|
| 544,219 | A * | 8/1895 | Godet | B65D 1/04 | 215/10 |
| 1,728,883 | A * | 9/1929 | Simon | B65D 1/04 | 215/373 |
| 4,294,372 | A * | 10/1981 | Onishi | B65D 1/04 | 220/555 |
| 8,584,842 | B2 * | 11/2013 | Fakhouri | A24F 15/18 | 206/256 |
| 8,602,210 | B2 * | 12/2013 | Milner | A24F 15/12 | 206/242 |
| 2006/0138169 | A1 * | 6/2006 | Cafferty | B65D 1/32 | 222/129 |

(Continued)

*Primary Examiner* — King M Chu
(74) *Attorney, Agent, or Firm* — Christopher & Weisberg, P.A.

(57) ABSTRACT

A container including a housing. The housing includes an outer wall, a first compartment, a second compartment, and a third compartment. The outer wall has a first end defining a first opening and a second end defining a second opening opposite the first opening. The first compartment is open at the first opening and closed at the second opening. The second compartment is adjacent the first compartment and separated from the first compartment by a first dividing wall. The second compartment is open at the second opening and closed at the first opening. The third compartment is adjacent the second compartment and separated from the second compartment by a second dividing wall. The third compartment is open at the first opening and closed at the second opening. The first and second dividing walls each extend from the first opening to the second opening and taper inward towards the second end.

17 Claims, 6 Drawing Sheets

(56) References Cited

U.S. PATENT DOCUMENTS

| | | | | |
|---|---|---|---|---|
| 2008/0179270 | A1* | 7/2008 | Thibaut | B65D 81/3205 215/6 |
| 2009/0050495 | A1* | 2/2009 | Marcus | B65D 51/28 206/217 |
| 2013/0255700 | A1* | 10/2013 | Geraths | A24F 23/04 131/180 |
| 2014/0061073 | A1* | 3/2014 | Haidar | A24F 23/00 206/256 |
| 2021/0130041 | A1* | 5/2021 | Sharpe | B65D 47/06 |

* cited by examiner

MULTI-COMPARTMENT DUAL LID STORAGE CONTAINER

CROSS-REFERENCE TO RELATED APPLICATIONS

This application is related to and claims priority to U.S. Provisional Patent Application Ser. No. 63/144,595, filed Feb. 2, 2021, entitled MULTI-COMPARTMENT DUAL LID STORAGE CONTAINER, the entirety of which is incorporated herein by reference.

TECHNICAL FIELD

This disclosure relates storage containers, and in particular, storage containers having dual lids and multiple interior compartments.

INTRODUCTION

Packaging for pre-rolled cigarettes usually consists of a non-disposable container or box in which all cigarettes are packaged together in a single, or same, compartment. If the user of a cigarette extinguishes the cigarette, but does not wish to discard it, the partially smoked cigarette is typically placed back into the original single compartment box together. Because the box consists of a single compartment, the partially-smoked cigarette is in close proximity to any other unused cigarettes, which causes the unused cigarettes to become dirty from both the smell and loose ash from the partially-smoked cigarette.

Known containers are typically a single compartment for storing assembled cigarettes. The containers may be in the form of a tube or a box having a rectangular cross section, among other forms. The container also includes a lid that covers the compartment. In one example, the lid is rotatable between open and closed positions. However, the lid merely functions to contain the cigarettes within the compartment, and does not provide an airtight seal. Consequently, a humidity level within the compartment cannot be maintained and odors are allowed to escape, not only alerting others to the contents of the container, but also allowing the cigarettes to dry out. Additionally, the lack of an airtight seal also allows odors, moisture, and light from entering the compartments, which may also be detrimental to the cigarettes. Another disadvantage is that it can be very difficult to re-insert partially smoked cigarettes into the compartment without mess. Known containers do not facilitate the easy removal of partially-smoked cigarettes from the compartment. For example, because partially-smoked cigarettes are located in the same compartment as unused cigarettes, the user must sift through all of the unused cigarettes in order to retrieve the partially-smoked cigarette, or any other particular cigarette, the user may be looking for. Finally, known containers are not intended to be disposable, and may thus be constructed from expensive materials.

SUMMARY

A container including a housing. In one embodiment, the housing includes an outer wall, a first compartment, a second compartment, and a third compartment. The outer wall has a first end defining a first opening and a second end defining a second opening that is opposite of the first opening. The first compartment is open at the first opening and is closed at the second opening. The second compartment is adjacent to the first compartment and is separated from the first compartment by a first dividing wall. The second compartment is open at the second opening and is closed at the first opening. The third compartment is adjacent to the second compartment and is separated from the second compartment by a second dividing wall. The third compartment is open at the first opening and closed at the second opening. The first and second dividing walls each extend from the first opening to the second opening and taper inward towards the second end.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

Figure 1:
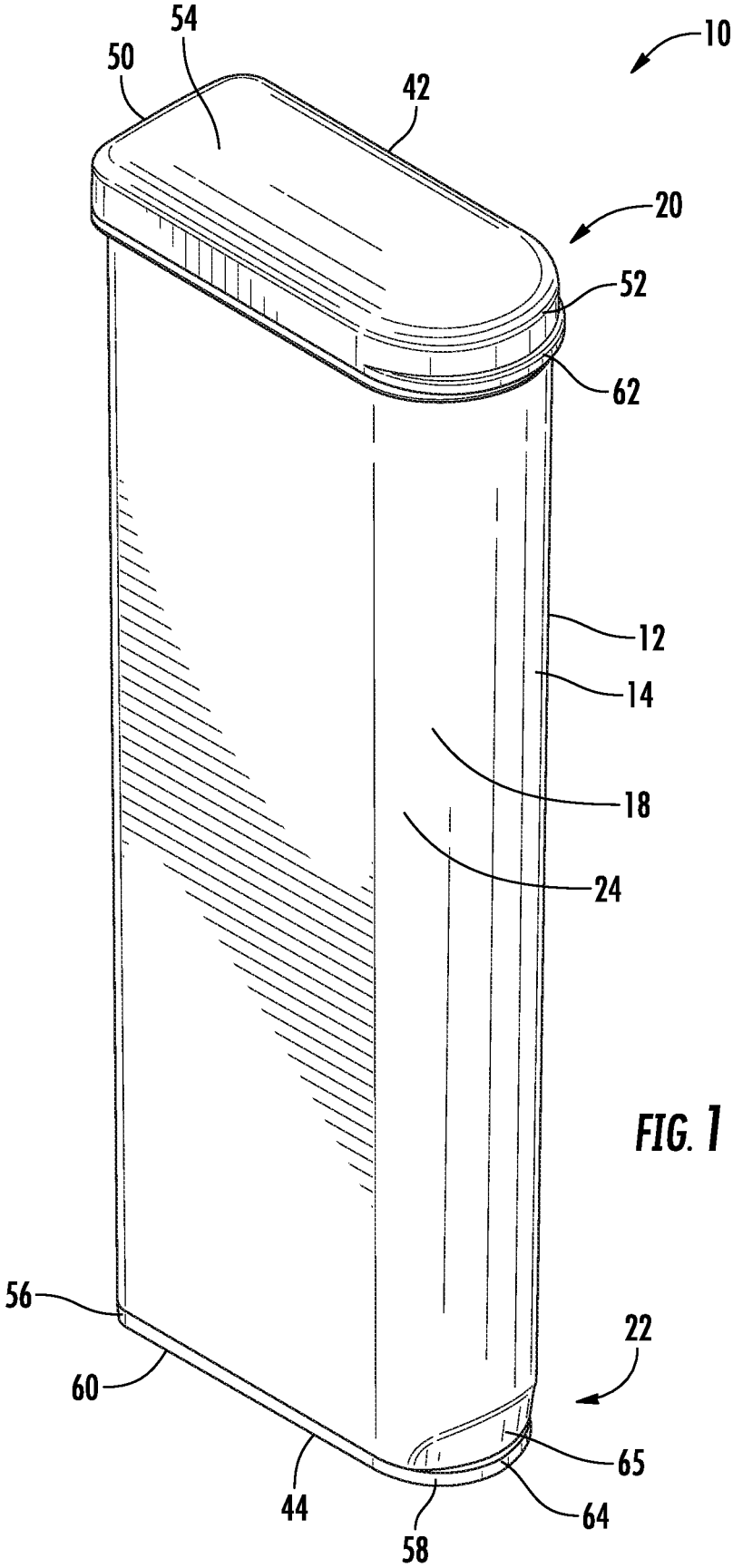
FIG. 1 shows an upper perspective view of a container for storing cigarettes, with a first and second lid in a closed position.

Before describing in detail exemplary embodiments, it is noted that the embodiments reside primarily in combinations of apparatus components and processing steps related to a device for storing loose or assembled cigarettes, and a method of using the same Accordingly, the system and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 2:
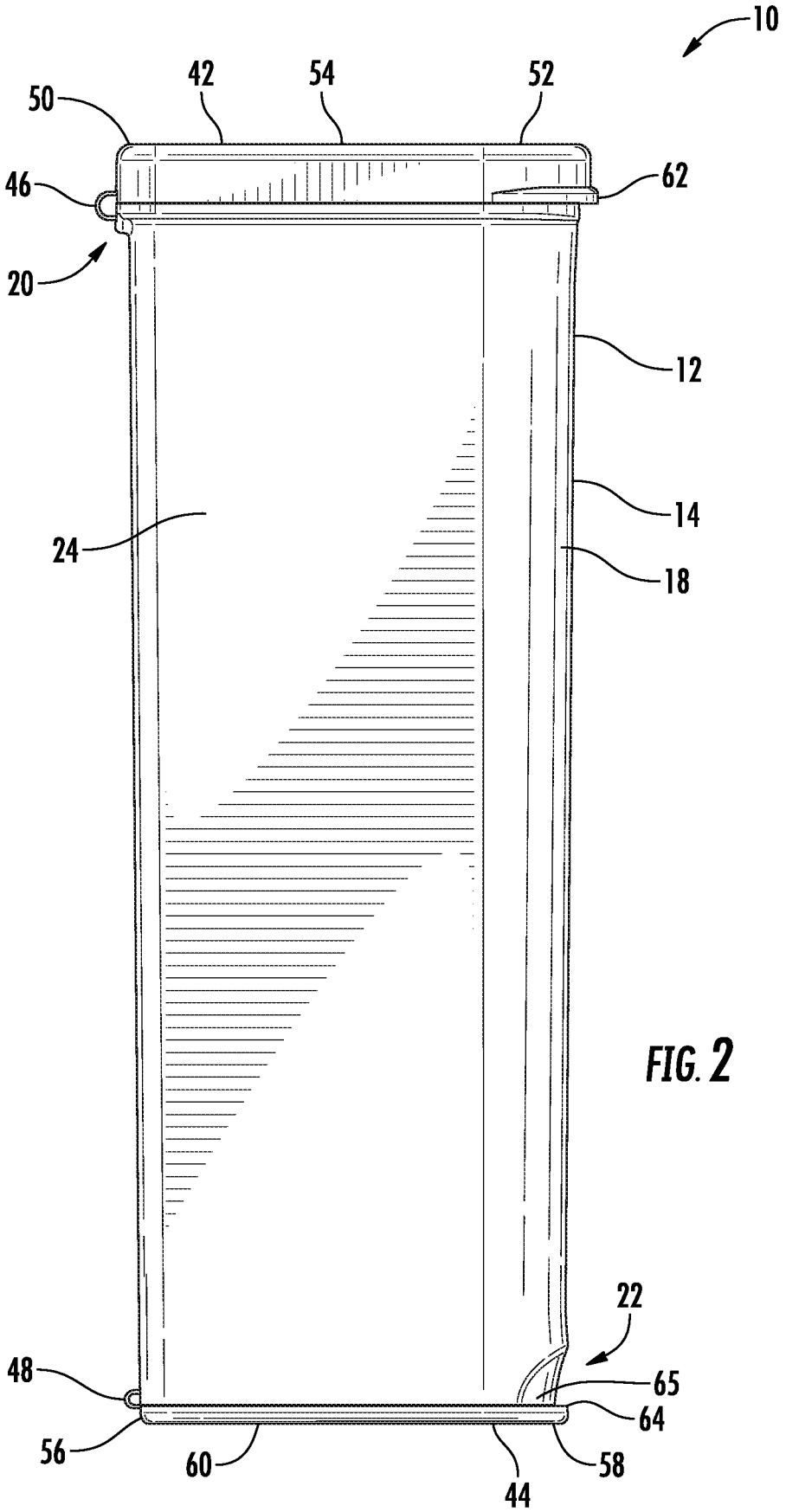
FIG. 2 shows a side view of the container of FIG. 1.
Figure 3:
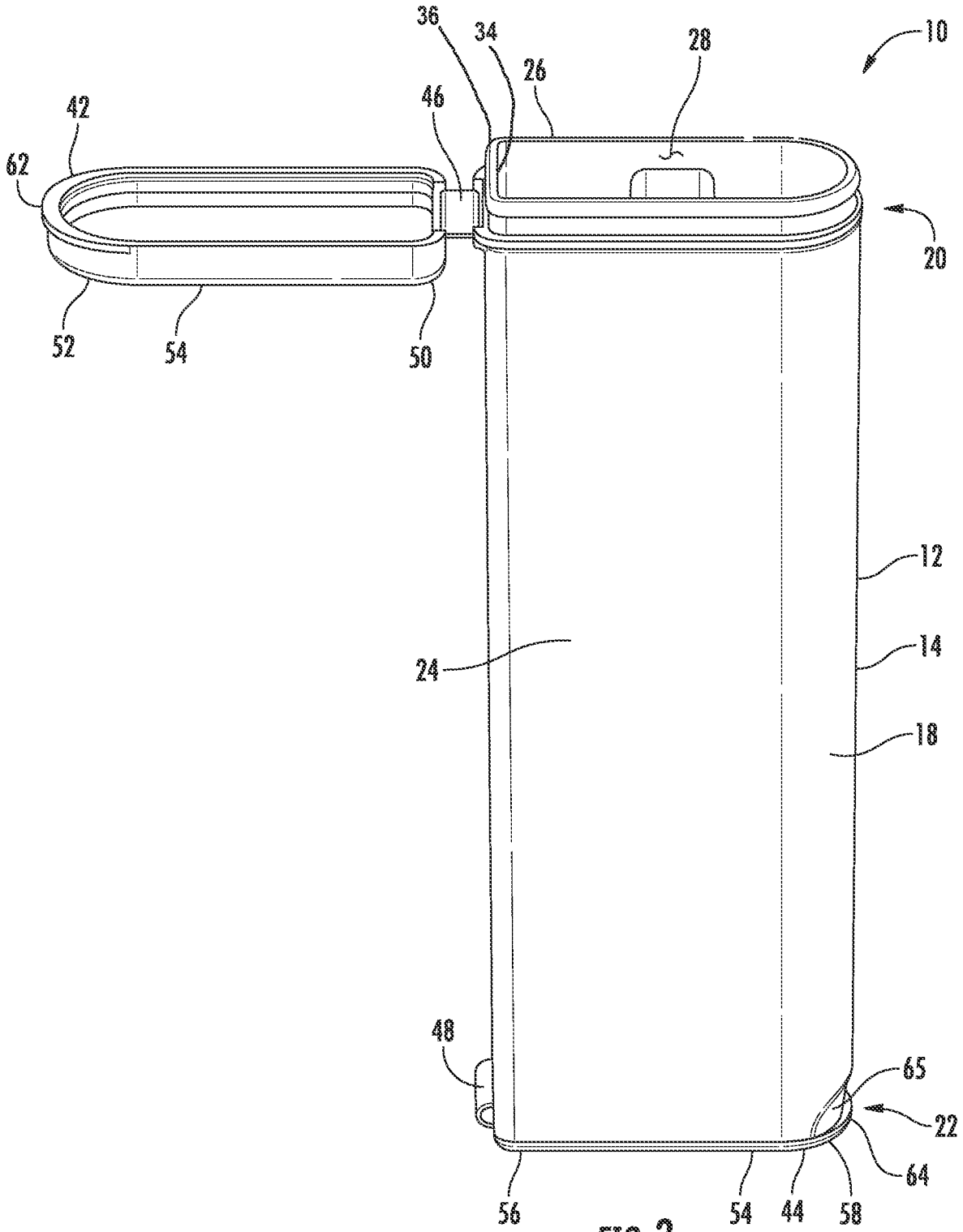
FIG. 3 shows an upper perspective view of the container of FIGS. 1-2, with the first lid open in an open position.
Figure 4:
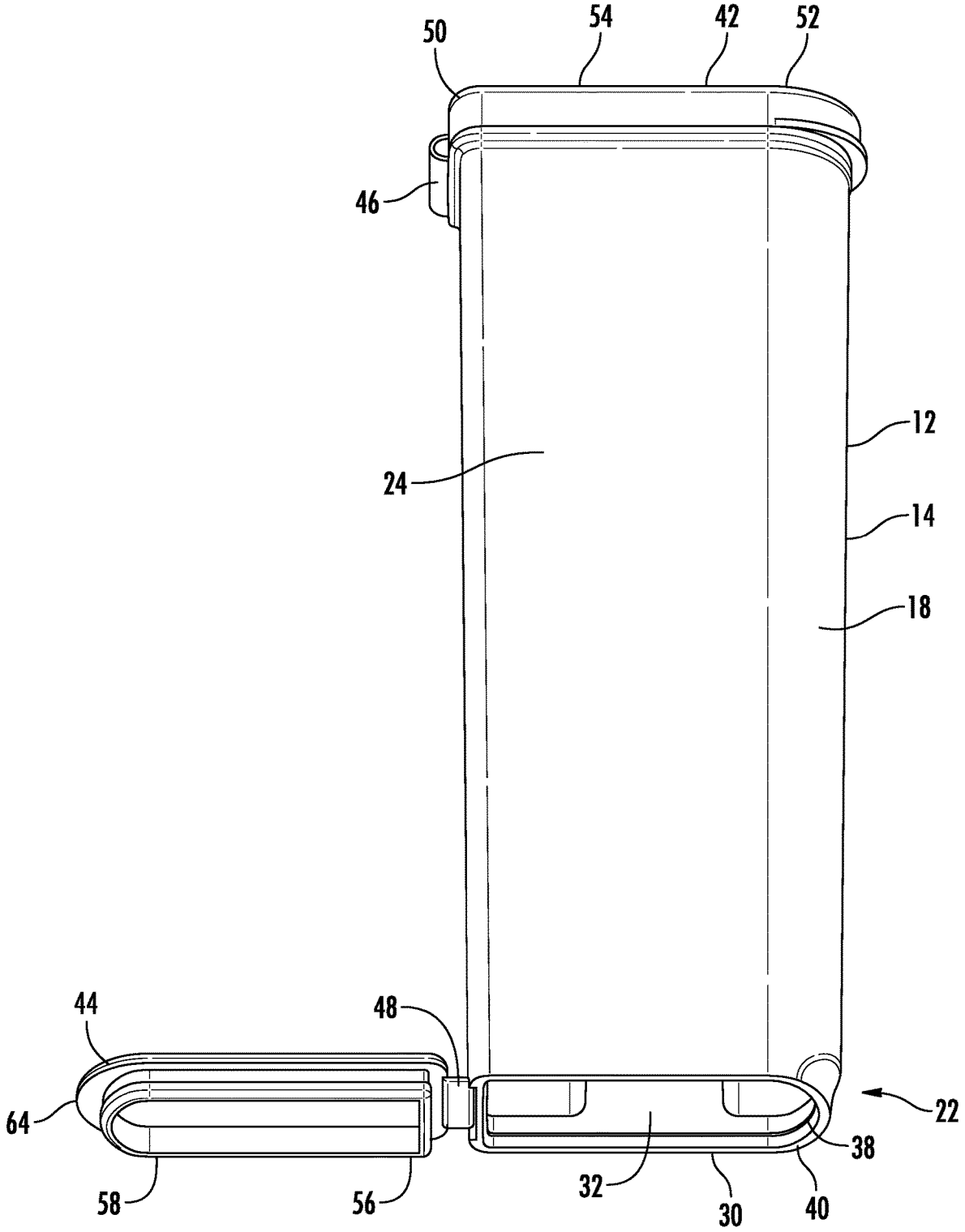
FIG. 4 shows a lower perspective view of the container of FIGS. 1-3, with the second lid in an open position.

Referring now to FIGS. 1-8, a container 10 is shown that is sized and configured to contain loose or assembled (i.e., rolled) cigarettes, or the like, and is sized to fit within a user's hand, pocket, purse, bag, or pouch, etc. The container 10 includes a housing 12 having an outer wall 14 defining an inner surface 16 and an opposite outer surface 18. The housing 12 may be composed of any nonporous material that is suitable to prevent odors, moisture, light (in embodiments where an opaque or translucent housing is desired), and other conditions prevalent in the ambient environment from penetrating into the interior of the container 10. The housing 12 may have right-angled edges and/or rounded or curved edges, as shown in FIGS. 1-2. However, it will be understood that other dimensions and configurations may be used.

Referring now to FIGS. 1-4, the housing 12 may include an upper or first end 20, a lower or second end 22 opposite the first end 20, and a lateral surface 24 extending therebetween. As shown in more detail in FIGS. 3 and 4, the first end 20 includes a first rim 26 defining a first opening 28, and the second end 22 includes a second rim 30 defining a second opening 32. The first and second rim 26, 30 each have an inner circumscribed portion 34, 38 and an outer circumscribed portion 36, 40, respectively.

As shown in FIGS. 1-4, the container 10 includes a first lid 42 and/or a second lid 44 connected to the outer wall 14 of the housing 12. At least one of the lids 42, 44 may be formed as a unitary structure with the outer wall 14. The first lid 42 may be connected to the outer wall 14 at the first end 20 by a first hinge 46, and the second lid 44 may be connected to the outer wall 14 at the second end 22 by a second hinge 48, so that each lid 42, 44 may transition between an open position and a closed position.

The first lid 42 includes a proximal end 50, a distal end 52 opposite the proximal end 50, and a lateral surface 54 extending therebetween. Similarly, the second lid 44 also includes a proximal end 56, a distal end 58, and a lateral surface 60 extending between the proximal end 56 and distal end 58. The first hinge 46 is disposed proximate to the proximal end 50 of the first lid 42 and the second hinge 48 is disposed proximate to the proximal end 56 of the second lid 44. The lateral surface 54, 60 of each lid 42, 44 may be substantially flat or planar to serve as a base to allow the container 10 to stand vertically when placed on a flat surface, regardless of which lid 42, 44 is used as the base. Alternatively, either of the lids 42, 44 may also have a rounded or curved lateral surface 54, 60.

When operated in the closed position, the first lid 42 couples to the outer circumscribed portion 36 of the first rim 26, and the second lid 44 couples to the inner circumscribed portion 38 of the second rim 30. However, in other embodiments, it is understood that the first lid 42 may instead be coupled to the inner circumscribed portion 34, and the second lid 44 may be coupled to the outer circumscribed portion 40 or combinations thereof. In other words, embodiments are not limited to one of lids 42 and 44 coupling to an outer circumscribed portion of the corresponding rim and the other one of lids 42 and 44 coupling to an inner circumscribed portion of the corresponding rim. To transition from the closed position to the open position, the distal ends 52, 58 of each respective lid 42, 44 may include a straight, rounded, or curved edge that defines a lip portion. The lip portion 62 of the first lid 42 and the lip portion 64 of the second lid 44 enable a user to more easily push or pull open either lid 42, 44, to gain access the interior of the housing 12. The outer surface 18 of the housing 12 may also define a recessed portion 65 proximate to the second end 22 to allow a user to more easily engage the lip portion 64 of the second lid 44.

Figure 5:
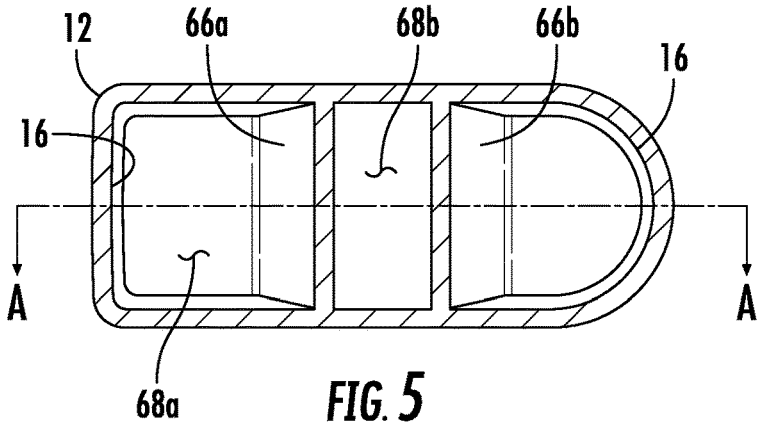
FIG. 5 is a top sectional view of the container of FIGS. 1-4, showing the slope of each interior housing compartment in a three-compartment embodiment.
Figure 6:
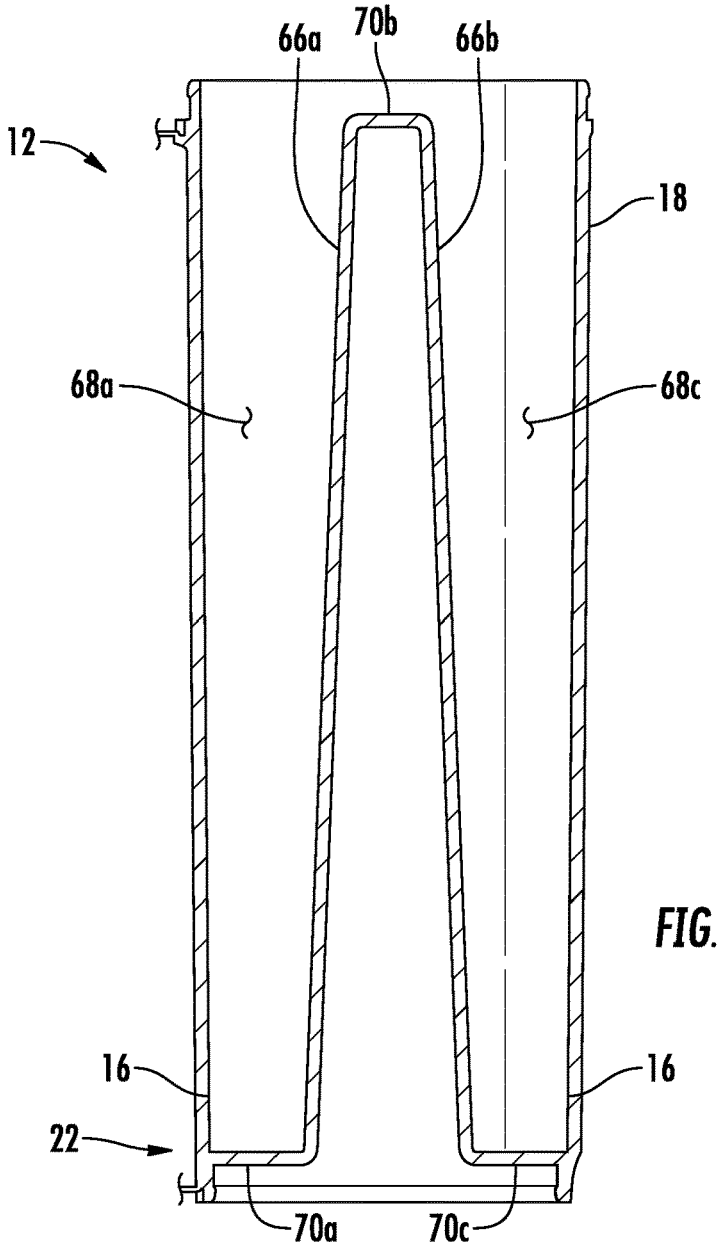
FIG. 6 is a view of the container of FIG. 5 taken through cross-section A-A, without the first and second lids, showing the interior of the housing in the three-compartment embodiment.

In a first non-limiting embodiment, for example, as shown in FIGS. 5-6, the housing 12 may include a first dividing wall 66*a* and a second dividing wall 66*b* that extend between the first end 20 and the second end 22 to define a first compartment 68*a*, a second compartment 68*b*, and a third compartment 68*c*, within the housing 12. In one embodiment, the outer wall 14, the first dividing wall 66*a*, and the second dividing wall 66*b* may be formed as a unitary structure. Alternatively, the compartments 68*a*, 68*b*, 68*c* may be formed as a removable insert that may be retained within the housing 12.

Each compartment 68*a*, 68*b*, 68*c* is sized and configured to retain loose and/or assembled cigarettes, or any other materials or objects as desired by the user. The first compartment 68*a* may be open at the first opening 28 and closed at the second opening 32. The second compartment 68*b* is adjacent to the first compartment 68*a* and is separated by the first dividing wall 66*a*. The second compartment 68*b* is open at the second opening 32 and closed at the first opening 28. The third compartment 68*c* is adjacent to the second compartment 68*b* and is separated by the second dividing wall 66*b*. The third compartment 68*c* is open at the first opening 28 and closed at the second opening 32. The separation of each compartment 68*a*, 68*b*, 68*c* by the dividing walls 66*a*, 66*b*, allows for organization within in the container 10, where new cigarette(s) can be kept in compartments separate from a partially-smoked cigarette(s). For example, new cigarettes can be kept in the outer compartments 68*a* and 68*c*, and a partially smoked cigarette can be kept in the inner compartment 68*b*. The openings of the first and third compartments 68*a*, 68*c* are then sealed by the first lid 42, and the opening of the second compartment 68*b* is sealed by the second lid 44, when the first and second lids 42, 44 are in the closed position. The airtight sealing of each compartment 68*a*, 68*b*, 68*c* by the first and second lids 42, 44 prevents odors from the partially-smoked cigarette from reaching the new cigarettes, and thus avoiding adversely affecting the smell or taste of the new cigarettes. Additionally, the sealing of the first, second, and third compartments 68*a*, 68*b*, 68*c* by the first and second lids 42, 44 also prevents odors, moisture, light, and other conditions prevalent in the ambient environment from entering the compartments 68*a*, 68*b*, 68*c* and affecting or contaminating any cigarettes that may be retained within. Further, the airtight seal provided by the lids 42, 44, also prevents odors emanating from the cigarettes from escaping the compartments 68*a*, 68*b*, 68*c* and entering the atmosphere.

Each of the first, second, and third compartments 68*a*, 68*b*, 68*c* includes a closed end proximate to either the first or second openings 28, 32. For example, the first dividing wall 66*a* is in contact with the inner surface 16 of the outer wall 14 to form a closure 70*a* of the first compartment 68*a* proximate to the second opening 32. The first and second dividing walls 66*a*, 66*b* meet to form a closure 70*b* of the second compartment 68*b* proximate to the first opening 28. Similar to the first dividing wall 66*a*, the second wall 66*b* is also in contact with the inner surface 16 of the outer wall 14 to form a closure 70*c* of the third compartment 68*c* proximate to second opening 32. The closures 70*a*, 70*b*, 70*c* of each compartment 68*a*, 68*b*, 68*c* may each define a substantially planar, angular, or conically-shaped surface formed by a meeting of the dividing walls 66*a*, 66*b*, or the meeting of either wall 66*a*, 66*b* and the inner surface 16 of the outer wall 14.

As shown in more detail in FIG. 6, the first and second dividing walls 66*a*, 66*b* taper inwards from the first end 20 to the second end 22 such that the width of the first and third compartments 68*a*, 68*c* are larger proximate to the first opening 28 and smaller proximate to the second opening 32. As a result, the width of the second compartment 68*b* is larger proximate to the second opening 32 and a smaller proximate to the first opening 28. Further, each compartment 68*a*, 68*b*, 68*c* may have a substantially similar or different surface area as the other compartments. For example, the first compartment 68*a* may have a surface area equal to, greater than, or less than, the surface area of either the second compartment 68*b* and/or the third compartment 68*c*. Such an arrangement allows for the storage of cigarettes whose thickness, e.g., diameter, is tapered along the length of the cigarette.

The first and second dividing walls 66*a*, 66*b* may also be made of a similar nonporous material as the housing 12 that is suitable to prevent odors, moisture, light, and other conditions prevalent in the ambient environment from penetrating the container 10 and the compartments 68*a*, 68*b*, 68*c*, which may help preserve the smell, taste, and freshness of the cigarettes. Further, the first and second dividing walls 66*a*, 66*b* may also be rigid so that the walls 66*a*, 66*b* are not easily bent inwards and/or outwards when inserting or removing the cigarettes from the first, second, and third compartments 68*a*, 68*b*, 68*c*. Additionally, and/or alternatively, in some embodiments the first and second dividing walls 66*a*, 66*b* may also have a resilient characteristic that may be more forgiving when the user is attempting to insert larger rolled cigarettes into the compartments 68*a*, 68*b*, 68*c*. The resiliency of the dividing walls 66*a*, 66*b* may help prevent the walls 66*a*, 66*b*, from cracking or breaking due to excess pressure exerted on the walls 66*a*, 66*b* from the insertion or removal of the cigarette.

Figure 7:
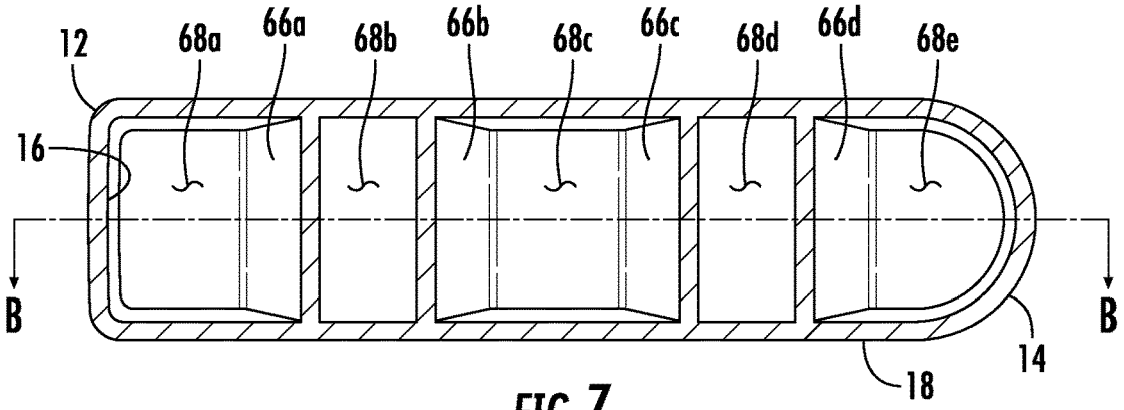
FIG. 7 is a top sectional view of the container of FIGS. 1-4, showing the slope of each interior housing compartment in a five-compartment embodiment.
Figure 8:
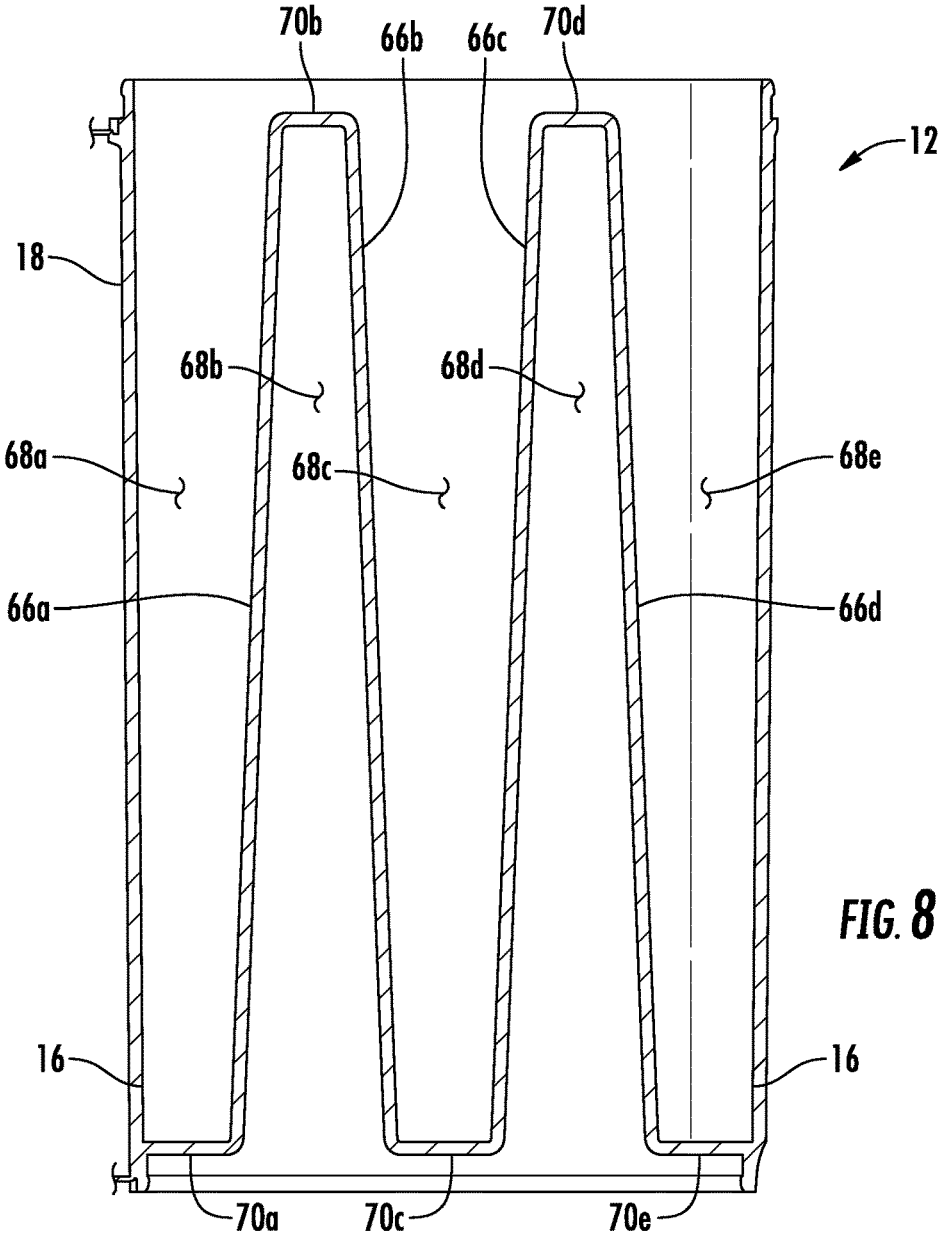
FIG. 8 is a view of the container of FIG. 7 taken through cross-section B-B, without the first and second lids, showing the interior of the housing in the five-compartment embodiment.

Now referring to FIGS. 7 and 8, a second embodiment of the container 10 is shown in which the housing 12 may include a fourth compartment 68*d* and a fifth compartment 68*e*, which may also be sealed by the first and second lids 42, 44. The overall compartmental structure of the embodiment shown in FIGS. 7 and 8 is similar to that shown and described with reference to FIGS. 5 and 6. The fourth compartment 68*d* is adjacent to the third compartment 68*c* and separated by a third dividing wall 66*c*. The fifth compartment 68*e* is adjacent to the fourth compartment 68*d* and is separated by a fourth dividing wall 66*d*. The third and fourth dividing walls 66*c*, 66*d* each extend from the first opening 28 to the second opening 32 and taper inwards towards the second end 22. It is to be understood that the third and fourth dividing walls 66*c*, 66*d* may also include similar structural characteristics as the first and second dividing walls 66*a*, 66*b* described herein. For example, the third and fourth dividing walls 66*c*, 66*d* may be rigid to prevent the walls 66*c*, 66*d* from being easily bent inwards and/or outwards when inserting or removing cigarettes from the third, fourth, and fifth compartments 68*c*, 68*d*, 68*e*. The third and fourth dividing walls 66*c*, 66*d* may also have a resilient characteristic that may be more forgiving when the user is attempting to insert larger cigarettes into the compartments 68*c*, 68*d*, 68*e*. The resiliency of the dividing walls 66*c*, 66*d* may help prevent the walls 66*c*, 66*d*, from cracking or breaking due to excess pressure exerted on the walls 66*c*, 66*d* from the insertion or removal of the cigarette.

As shown in more detail in FIG. 8, the first dividing wall 66*a* meets the inner surface 16 of the outer wall 14 to form the closure 70*a* of the first compartment 68*a*. The first and second dividing walls 66*a*, 66*b* meet to form the closure 70*b* of the second compartment 68*b*. The second and third dividing walls 66*b*, 66*c* meet to form the closure 70*c* of the third compartment 68*c*. The third and fourth dividing walls 66*c*, 66*d* meet to form a closure 70*d* of the fourth compartment 68*d*. Lastly, the fourth dividing wall 66*d* meets the inner surface 16 of the outer wall 14 to form a closure 70*e* of the fifth compartment 68*e*. The closures 70*b*, 70*d* of the second and fourth compartments are proximate to the first opening 28, and the closures 70*a*, 70*c*, 70*e* of the first, third, and fifth compartments 68*a*, 68*c*, 68*e* are proximate to the second opening 32. In this five-compartment embodiment, the first lid 42 can provide an airtight seal against the first, third, and fifth compartments 68*a*, 68*c*, 68*e* and the second lid can provide an airtight seal against the second and fourth compartments 68*b*, 68*d* so that new cigarettes can be kept separate from partially-smoked cigarettes. For example, new cigarettes can be kept in the first, third, and fifth compartments, and partially-smoked cigarettes can be kept in the second and fourth compartments 68*b*, 68*d*. The sealing of the second and fourth compartments 68*b*, 68*d* by the second lid 44 prevents odors from escaping the second and fourth compartments 68*b*, 68*d* and reaching the new cigarettes in the first, third, and fifth compartments 68*a*, 68*c*, 68*e*. Further, the airtight seal provided by the lids 42, 44, also prevents odors emanating from the cigarettes from escaping the compartments 68*a*, 68*b*, 68*c*, 68*d*, 68*e* and entering the atmosphere.

As described herein and as noted above, it is understood that the five-compartment embodiment of the container 10 may include any and/or all of the features of the three-compartment embodiment of the container 10. However, the dimensions of the housing 12 of the five-compartment embodiment of the container 10 may be adjusted to accommodate the presence of the fourth and fifth compartments 68*d*, 68*e*, and the third and fourth dividing walls 66*c*, 66*d*. Furthermore, the container 10 is not limited to the 3-compartment and 5-compartment embodiments described herein. For example, in other various embodiments, the housing 12 of the container 10 may include additional, or fewer, interior compartments. For example, it is contemplated that the container 10 may have just two compartments, where one compartment is open at the first end 20 and the other compartment is open at the second end 22, with a single dividing wall separating the two compartments. Additionally, in any embodiment of the container 10, any combination of the outer well 14, first and second lids 42, 44, dividing walls 66*a*-66*d*, and compartments 68*a*-68*e*, may be molded together as a unitary structure to form the container 10. The container 10 may be made by molding a material, such as, for example, a polymer or the like.

It will be appreciated by persons skilled in the art that the present embodiments are not limited to what has been particularly shown and described herein above. In addition, unless mention was made above to the contrary, it should be noted that all of the accompanying drawings are not to scale. A variety of modifications and variations are possible in light of the above teachings.

The invention claimed is:

1. A container, comprising:

a housing including:

an outer wall, the outer wall having a first end defining a first opening and a second end defining a second opening opposite the first opening;

a first lid hingedly connected to the outer wall of the housing at the first end for operation of the first lid between an open position and a closed position;

a second lid hingedly connected to the outer wall of the housing at the second end for operation of the second lid between an open position and a closed position;

a first compartment within the outer wall, the first compartment being open at the first opening and closed at the second opening;

a second compartment within the outer wall, adjacent the first compartment and separated from the first compartment by a first dividing wall, the second compartment being open at the second opening and closed at the first opening;

a third compartment within the outer wall, adjacent the second compartment and separated from the second compartment by a second dividing wall, the third compartment being open at the first opening and closed at the second opening; and the first and second dividing walls each extending from the first opening to the second opening and tapering inward towards the second end, the first dividing wall including a first closure and a first portion, the first closure being in contact with the outer wall and being proximate the second end and the first portion being proximate the first end, the second dividing wall including a second closure and a second portion, the second closure being in contact with the outer wall and being proximate the second end and the second portion being proximate the first end, the first and second dividing walls meeting to form a third closure of the second compartment proximate the first opening; and the third closure is proximate the first lid, when the first lid is in the closed position.

2. The container of claim 1, wherein the first lid has a proximal end, a distal end, and a first hinge, the first hinge being disposed proximate to the proximal end of the first lid.

3. The container of claim 1 wherein the second lid has a proximal end, a distal end, a second hinge, the second hinge being disposed proximate to the proximal end of the second lid.

4. The container of claim 3, wherein at least one of the first lid and the second lid are formed as a unitary structure with the outer wall.

5. The container of claim 4, wherein the outer wall, the first dividing wall and the second dividing wall are formed as a unitary structure.

6. The container of claim 5, further comprising a third closure, the first portion of the first dividing wall and the second portion of the second dividing wall being proximate the third closure.

7. The container of claim 6, wherein the outer wall has an inner surface and an outer surface opposite the inner surface, the first dividing wall in contact with a first portion of the inner surface to form the first closure of the first compartment proximate the second opening, and the second dividing wall in contact with a second portion of the inner surface to form the second closure of the third compartment proximate the second opening.

8. The container of claim 7, wherein the openings at the first and second ends of the housing are each defined by a rim, each rim having an inner circumscribed portion and an outer circumscribed portion.

9. The container of claim 8, wherein the first lid couples to the outer circumscribed portion of the rim of the first end when in the closed position.

10. The container of claim 9, wherein the second lid couples to the inner circumscribed portion of the rim of the second end when in the closed position.

11. The container of claim 10, wherein a surface area of the first compartment is substantially equal to a surface area of at least one of the second compartment and the third compartment.

12. The container of claim 1, wherein the housing further includes:

a fourth compartment adjacent to the third compartment and separated from the third compartment by a third dividing wall, the fourth compartment being open at the second opening and closed at the first opening; and a fifth compartment adjacent to the fourth compartment and separated from the fourth compartment by a fourth dividing wall, the fifth compartment being open at the first opening and closed at the second opening.

13. The container of claim 12, wherein the third and fourth dividing walls each extend from the first opening to the second opening and taper inward towards the second end.

14. The container of claim 13, wherein the first lid provides a seal against the first, third, and fifth compartments when in the closed position.

15. The container of claim 14, wherein the second lid provides a seal against the second and fourth compartment when in the closed position.

16. The container of claim 15, wherein:

the third and fourth dividing walls meet to form a fourth closure of the fourth compartment proximate the first opening; and the second and third dividing walls meet to form a fifth closure of the third compartment proximate the second opening.

17. The container of claim 16, wherein the outer wall has an inner surface and an outer surface opposite the inner surface, the first dividing wall in contact with a first portion of the inner surface to form the first closure of the first compartment proximate the second opening, and the fourth dividing wall in contact with a second portion of the inner surface to form a sixth closure of the fifth compartment proximate the second opening.

* * * * *